United States Patent [19]

Tigner

[11] Patent Number: 4,738,384

[45] Date of Patent: Apr. 19, 1988

[54] DISPENSER

[76] Inventor: Calvin L. Tigner, 1035 N. Albany Rd., Albany, Oreg. 97321

[21] Appl. No.: 870,894

[22] Filed: Jun. 5, 1986

[51] Int. Cl.[4] ..... B26D 1/02; B65D 85/671

[52] U.S. Cl. ..... 225/16; 225/32; 225/41; 225/43; 225/52; 225/53

[58] Field of Search ..... 225/15, 16, 32, 41, 225/43, 52, 53

[56] References Cited

U.S. PATENT DOCUMENTS

| | | | |
|---|---|---|---|
| 1,208,701 | 12/1916 | Trenner | 225/32 X |
| 2,096,107 | 10/1937 | Haggerty | 225/52 X |
| 2,110,827 | 3/1938 | Daykin | 225/52 X |
| 2,114,628 | 4/1938 | Carruthers | 225/53 |
| 2,125,754 | 8/1938 | Steiner | 225/53 |
| 2,643,070 | 6/1953 | Broeren et al. | 225/43 |
| 2,809,082 | 10/1957 | Marcuse | 225/32 X |
| 3,069,055 | 12/1962 | Steele et al. | 225/41 X |
| 4,204,618 | 5/1980 | Reed et al. | 225/41 X |
| 4,239,164 | 12/1980 | Barnsbee et al. | 225/52 X |

FOREIGN PATENT DOCUMENTS

| | | | |
|---|---|---|---|
| 648602 | 1/1951 | United Kingdom | 225/43 |

*Primary Examiner*—Frank T. Yost

*Attorney, Agent, or Firm*—Charles N. Hilke

[57] ABSTRACT

A transparent dispenser is disclosed for dispensing material, generally tickets. One side of the dispenser is hinged for entry into the dispenser. A curl is formed within the dispenser in order to guide the tickets from inside the dispenser to the outside of the dispenser. In a second embodiment of the dispenser, the top and two sides are made of one piece of material and are hingeably connected to the bottom and front, which are made of one piece of material. In the third embodiment, an axle and wheel rotate within the curl to advance the tickets from the inside of the dispenser to the outside of the dispenser. In all three embodiments, various mounting methods are provided.

3 Claims, 2 Drawing Sheets

DISPENSER

BACKGROUND OF THE INVENTION

1. Field of the Invention

The present invention relates to dispensers used for dispensing material, more particularly, tickets.

2. Description of the Prior Art

The necessity for state governments, primarily, to raise additional tax funds has proliferated throughout the states. Lotteries were quite common during the 19th century and state legislatures have been returning to lotteries in an effort to solve some of the financial problems of state governments. The difficulty with the non computerized lottery games has been the lack of a suitable dispenser which will attract the customer's attention, generally when purchasing other items at a checkout counter.

In U.S. Pat. No. 1,923,982 a card and ticket holder is disclosed which utilizes a cabinet from which the material is dispensed. In U.S. Pat. No. 2,946,636 an extension plate 19 is disclosed so a spent roll of toilet paper can be withdrawn from the holder. In U.S. Pat. No. 3,006,567 an electrical apparatus is shown which includes a guide heater 30 which is curled within the apparatus. In U.S. Pat. No. 3,517,804, a device is disclosed which shows a curved surface to guide the material. In U.S. Pat. No. 3,537,767, a spring 12 is guided under a cover and over side flanges. Finally, U.S. Pat. No. 4,239,164 discloses a light lock for a roll dispensing container used in the photography industry where an outer lip contains sufficient curvature to receive an inner lip.

None of the prior art allows for a simple manually operated dispensing device.

SUMMARY OF THE INVENTION

A dispenser is disclosed for dispensing material, generally tickets, where said dispenser is made of transparent material. The dispenser comprises a bottom, a top, a fixed side, a hinged side, and a front. Various mounting methods are provided including a bracket wall mount, mounting by means of wood screws through the front, the top, the bottom, or the fixed side. The front side contains a curl formed within the top curve portion. The top curve portion contains a top finger slot in order to advance the dispensed material by means of pressure upon the curl. Additionally, the top piece at the adjacent edge to the front piece is beveled to provide a cutting top edge for separation of dispensed materials. A front finger slot is provided in the front in order to easily grasp the dispensing material. The hinged side adjacent to the front contains a portion which forms the back part of a plastic hasp where indentations occur above and below said back part of a plastic hasp. Additionally, the front part of a plastic hasp is fixably attached to the front of the dispenser. A hole through the front and back part of the plastic hasp provides locking means for the dispenser.

In a second embodiment the two sides and top are made of one piece of material and are hingeably connected to the bottom and front which are made of one piece of material. Various mounting methods are retained. The curl is retained along with both top finger slot and front finger slot. A lock with lock arm positioned through a lock slot secures the two pieces of material together.

In the third embodiment the two hingeably connected pieces of the second embodiment are retained.

Within the curl is placed an axle and wheel where the wheel rotates through the curl wheel slot. The top finger slot is eliminated. A turn key rotates the wheel to dispense the dispensing material.

It is an object of this invention to provide visual accessability to the material within a dispenser.

It is another object of this invention to provide a dispenser which easily organizes the material to be dispensed.

It is another object of this invention to provide ease of placement of material to be dispensed within the dispenser.

It is another object of this invention to be able to easily dispense the material within the dispenser.

It is another object of this invention to be able to mount the dispenser by several different means.

It is another further object of this invention to provide a secure locked dispenser.

It is another further object of this invention to increase sales of the dispensing material.

It is another object of this invention to provide a simple dispenser without moving parts.

DESCRIPTION OF THE PREFERRED EMBODIMENT

Figure 1:
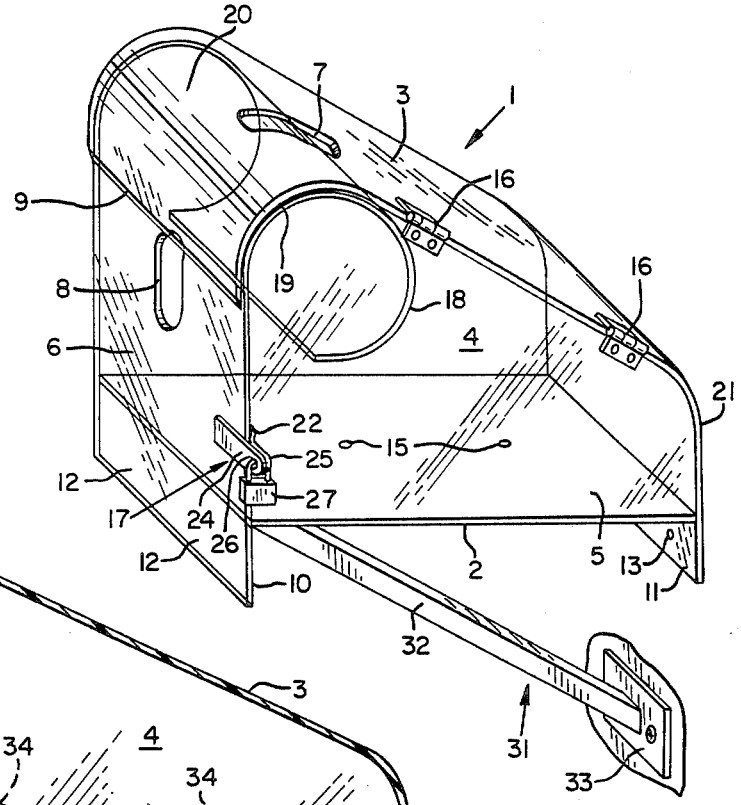
FIG. 1 is a top perspective view of the dispenser.

Reviewing FIG. 1, the top 3 is fixably attached to the bottom 2 and fixably attached to the fixed side 4. The bottom 2 is fixably attached to the top 3, the fixed side 4, and the front 6. The hinge side 5 is hingeably attached to the top 3. The front 6 contains a curl 18 where said curl 18 is fixably attached to the fixed side 4. In the top 3 is a top finger slot 7 under which is the curl 18. Generally, the gap 19 between the curl 18 and the top 3 is one-sixteenth of an inch. Note that the top 3 has a top curve 20 into which the top finger slot 7 is cut. The top 3 terminates adjacent to the front 6 in a cutting top edge 9. The cutting top edge 9 is sufficiently designed so that it can cut the material at that point or the material has perforations which are separated by the cutting top edge 9. In order to advance the dispensed material, a front finger slot 8 is cut into the front 6 close to the bottom 2 and below the cutting top edge 9. Hinges 16 are provided to connect the hinged side 5 to the top 3. Note also that the top is rounded at the back 21 to fit the curved portion of the hinged side 5 and the fixed side 4. Note also that the fixed side 4 and the hinged side 5 can be positioned on either side of the dispenser 1.

A portion of the hinged side 5 is extended at a position adjacent to the front 6 in order to form the back part 25 of a plastic hasp 17. Note also that a cut out 22 is provided above and below the back part 25. Attached to the front 6 is the front part 24 of a plastic hasp 17. Note that the front part 24 and the back part 25 contain a hole 26 which is positioned to receive a locking piece 27.

Various methods of mounting the dispenser 1 are shown. At least one or more front holes 12 are provided for the front counter mount 10. At least one or more back holes 13 are provided for the back counter mount 11. At least one or more side holes 14 are provided in the fixed side 4 for the side mount 29. At least one or more bottom holes 15 are provided for the bottom mount. A bracket 31 is provided for a wall mount. Note in this configuration that the hinged side 5 must, for wall clearance purposes, have a piece removed in order to allow the hinged side 5 to open. The dotted line 23 shows the appropriate cut for the removed portion of the hinged side 5. Also note that the bracket 31 is a V shape straight piece 32 which fixably attaches to the wall mount 33 and to the wall itself. Wherever mounted occurs, a plastic washer 28 is used to prevent cracking the dispenser 1.

Figure 3:
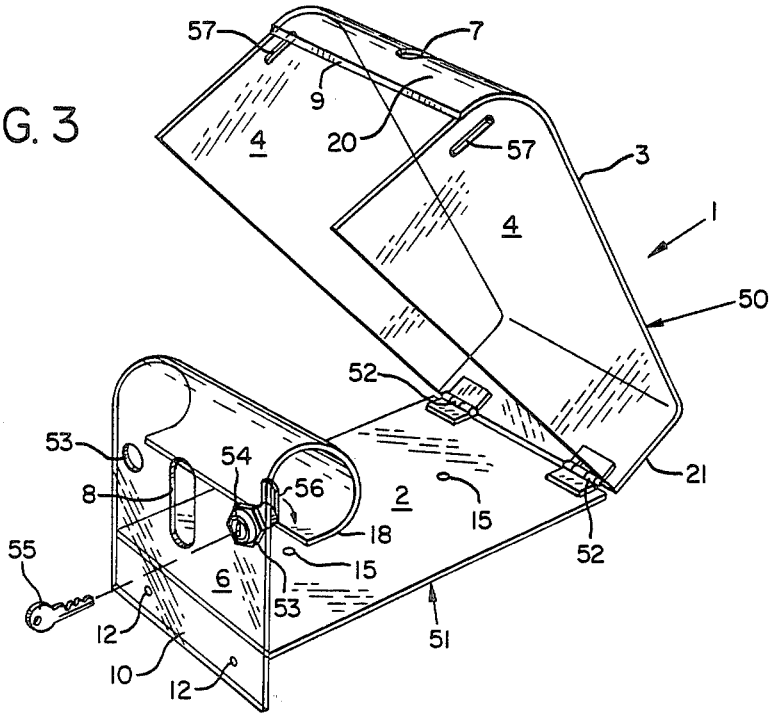
FIG. 3 is a top perspective view of the partially opened dispenser illustrating the second embodiment.

Reviewing FIG. 3 in relation to FIG. 1, the upper piece 50 is hingeably connected to the lower piece 51. The upper piece 50 is comprised of the top 3, the fixed side 4 and the hinged side 5, all fixably attached. The lower side 51 is comprised of the bottom 2 and the front 6. The back hinges 52 hingeably connect the upper piece 50 to the lower piece 51.

Figure 2:
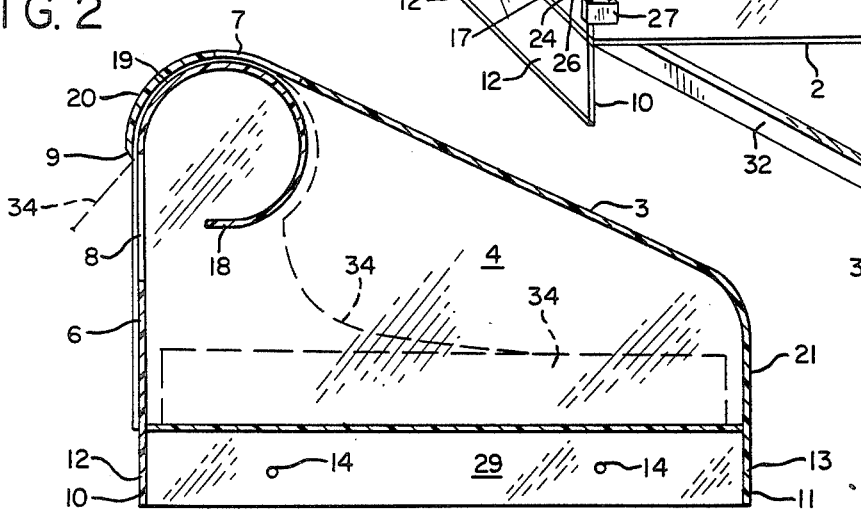
FIG. 2 is a cut away side view of the invention.

FIG. 2 shows the material 34 between the curl 18 and the top 3. In other words, the material 34 is in the gap 19. The material 34 exits from under the top 3 at the cutting top edge 9. Additionally, the material 34 also rests on the bottom 2 of the dispenser 1.

A lock 54 is placed in lock hole 53. A key 55 moves the lock arm 56 into the lock slot 57. All of the other features of the dispenser as shown in FIG. 1 are retained except the back counter mount 11 is eliminated.

Figure 4:
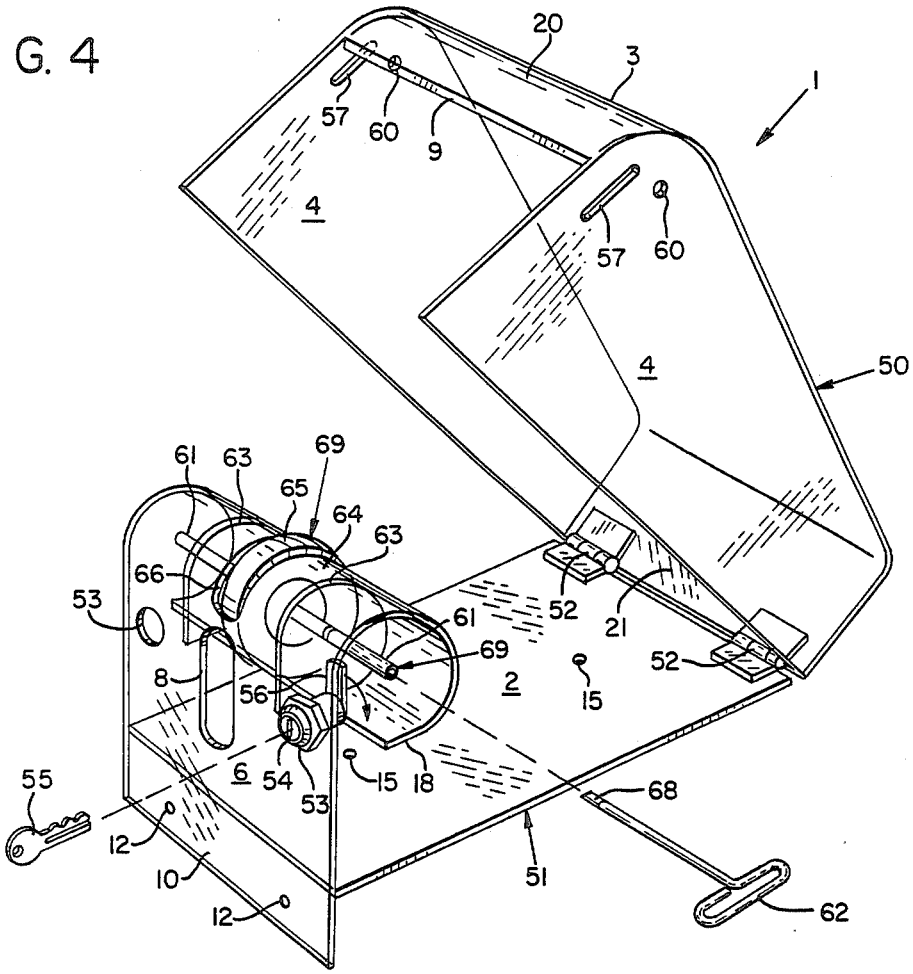
FIG. 4 is a top perspective view of the partially opened dispenser illustrating the third embodiment.
Figure 5:
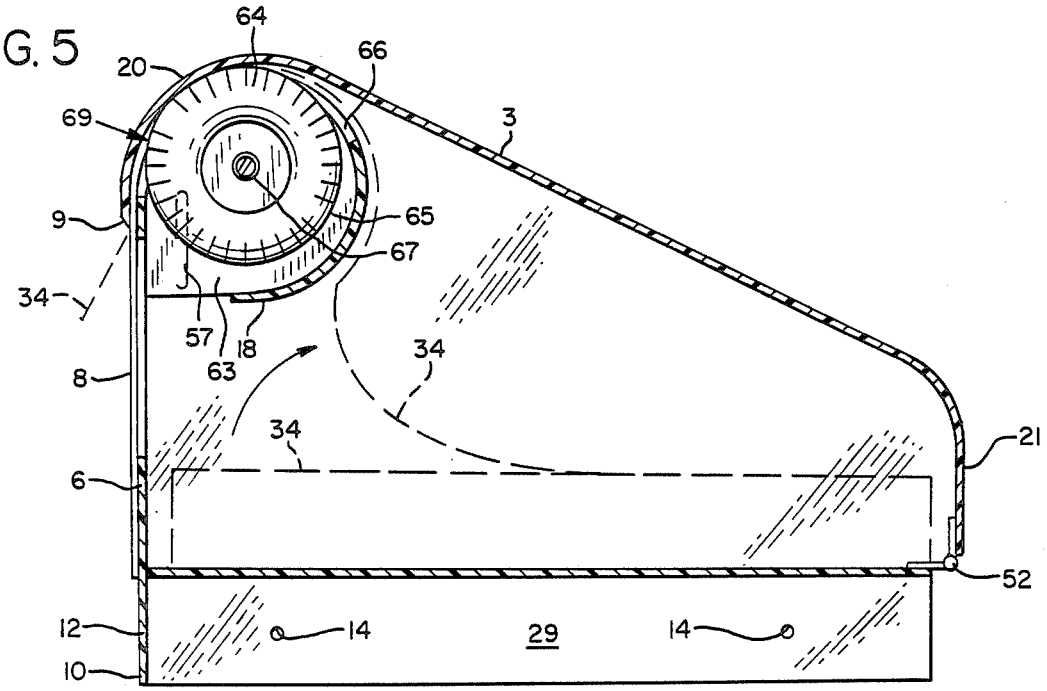
FIG. 5 is a cut away side view of the third embodiment.

FIG. 4 and FIG. 5 represent the third embodiment of the invention. In FIG. 4 the upper piece 50 has been changed in two ways from the second embodiment. The top finger slot 7 is eliminated. Turn key hole 60 is provided in each side 4 and 5. The lower piece 51 is changed from the second embodiment by the insertion of a turning mechanism 69 within the curl 18. The curl 18 has a curl wheel slot 66 within which rotates a wheel 64. The wheel 64 is mounted on axle supports 63 by means of a hollow axle 61. Within the hollow axle 61 is an axle fitting 67 into which a turn key fitting 68 of the turn key 62 can be placed. Outer wheel surface 65 is the outermost portion of the wheel 64.

In FIG. 5 the dispensing material 34 has been placed on the bottom two of the lower piece 51. The wheel 64 is positioned through the curl wheel slot 66 such that the outer wheel surface 65 presses against the top 3. The dispensing material 34 passes between the outer wheel surface 65 and the top 3 exiting at the cutting top edge 9.

In operation, the dispenser 1 is loaded with the material to be dispensed. This is accomplished by unlocking the locking means 27 so that the hinged side 5 may be raised. This opens the entire inner part of the dispenser 1. The material 34 is placed on the bottom 2 of the dispenser 1 and the beginning portion of the material 34 is fed over the curl 18 so that the material 34 to be dispensed is under the top finger slot 7. The hinged side 5 is closed and the locking piece 27 is inserted between the holes 26 of the front part 24 and back part 25 of the plastic hasp 17. In the second embodiment as shown in FIG. 3, the upper piece 50 is raised above the lower piece 51 or vice versa depending upon the mounting arrangement. This opens the entire part of the dispenser 1. The material 34 is placed on the bottom 2 of the lower piece 51 and the beginning portion of the material 34 is fed over the curl 18 so that the material to be dispensed is under the top figer slot 7 when the upper piece is positioned over the lower piece 51. In the third embodiment, the material 34 is placed within the dispenser 1 on the bottom 2 by means of opening lower piece 51 and upper piece 50. The material 34 is placed over the curl 18 and in contact with the outer wheel surface 65 of wheel 64. The dispenser 1 is closed so that the dispensing material 34 is frictionally held between the outer wheel surface 65 and the top 3. In order to dispense the material 34, the turn key 62 is placed through the turn key hole 60 and into the hollow axle 61 until the turn key fitting 68 engages the axle fitting 67. The turn key 62 is turned so that the wheel 64 turns against the top 3 causing the material 34 to exit under the cutting top edge 9. Because the dispenser 1 is made of clear, transparent material, a visual presentation of the dispensing material 34 is always available to a customer to entice them to purchase the dispensing material 34.

When a customer orders the dispensing material 34, a finger or thumb is placed into the top finger slot 7 and the dispensing material 34 is advanced towards the cutting top edge 9 by friction applied with the finger. The dispensing material 34 is held in place by the curl 18 underneath the top finger slot 7. When the dispensing material 34 reaches the front finger slot 8, the clerk simply pulls the dispensing material 34 until the appropriate amount reaches the cutting top edge 9. At this point, the dispensing material 34 to be sold is separated from that remaining in the dispenser by the cutting top edge 9. If necessary, the clerk again can retract some of the undispensed material 34 back into the dispenser, making sure that none of the dispensed material 34 is below the cutting top edge 9.

The other operation which is discussed is the mounting of the dispenser 1. It is readily apparent that the front counter mount 10, the back counter mount 11, the bottom mount 30 and the side mount 29 are accomplished by simply fixing attaching means through the appropriate holes provided in the dispenser 1. Note that the back mount may be accomplished by the extension of the top 3 below the bottom 2. Additionally, a separate L shaped piece may be fixably glued to the underside of the bottom where the back holes 13 adjacent to the wall or counter.

The invention has been described in detail with a particular reference to preferred embodiments thereof, but it will be understood that variations and modifications can be effected within the spirit and scope of this invention.

I claim:

1. A dispenser comprising:

a. a front with a curl;

b. a fixed side fixably-attached to said front with a front curl;

c. a top with a curved fitting over said front curl where said top is fixably attached to said fixed side;

d. a top finger slot cut within said top over said front curl;

e. a front finger slot cut into said front below said top;

f. a cutting edge formed at the termination of said top adjacent to said front; and g. at least one front hole in said front, at least one back hole in said back, and at least one side hole in said fixed side for mounting said dispenser by any one of said holes.

2. An enclosed dispenser comprising:

a. a front with a curl;

b. a fixed side fixably attached to said front with a front curl;
c. a top with a curve fitting over said front curl where said top is fixably attached to said fixed side;
d. a bottom fixably attached to said top and said fixed side and front;
e. a hinge side hingeably mounted to said top;
f. a top finger slot cut within said top over said front curl;
g. a front finger slot cut into said front below said top and above said bottom;
h. a cutting edge formed at the termination of said top adjacent to said front; and
i. at least one front hole, at least one back hole, at least one side hole, and at least one bottom hole for mounting said dispenser by any one of said holes.

3. A. An enclosed dispenser comprising:
a. an upper piece of two sides and a top;
b. a lower piece of a front and bottom hingeably attached to said upper piece where said lower piece includes a front curl having a slot cut into said curl proximate said top;
c. A turning mechanism rotatable within said front curl projecting through said slot in close proximity to said top of said upper piece in order to frictionally engage the material;
d. a key which engages a shaft to rotate said turning mechanism; and
e. at least one front hole, at least one side hole, and at least one bottom hole for mounting said dispenser by any one of said holes.

* * * * *